United States Patent [19]

Hallman et al.

[11] 4,103,808

[45] Aug. 1, 1978

[54] WATCHBAND

[76] Inventors: Edward L. Hallman, 707 Ridge St., Copperas Cove, Tex. 76522; Arthur E. Hallman, Jr., 6207 Cricket La., Columbus, Ga. 31904

[21] Appl. No.: 823,984

[22] Filed: Aug. 12, 1977

[51] Int. Cl.[2] ..... A45C 11/10

[52] U.S. Cl. ..... 224/4 D; 24/204; 58/105

[58] Field of Search ..... 224/4 D, 4 E, 4 F, 4 A, 224/28 W, 28 R, 4 B, 4 C, 4 H, 4 G, 4 J, 4 K, 5 R, 5 H; 2/DIG. 6; 58/105; 63/3; 24/DIG. 18

[56] References Cited

U.S. PATENT DOCUMENTS

| | | | |
|---|---|---|---|
| D. 139,671 | 12/1944 | Pereira | 224/4 D UX |
| 2,998,695 | 9/1961 | Cornett | 58/105 |

FOREIGN PATENT DOCUMENTS

| | | | |
|---|---|---|---|
| 580,932 | 10/1976 | Switzerland | 224/4 D |
| 368,650 | 3/1963 | Switzerland | 224/4 D |
| 172,423 | 2/1935 | Switzerland | 58/105 |
| 9,002 of | 1915 | United Kingdom | 224/4 F |

*Primary Examiner*—Trygve M. Blix
*Assistant Examiner*—Jerold M. Forsberg
*Attorney, Agent, or Firm*—C. A. Phillips

[57] ABSTRACT

A watchband having a protective flap for a watch which, when not in a protective position, is affixed around the back side of band. The band proper is adjustably fitted over one's wrist by interlocking Velcro surfaces, and the locking flap extends and is selectively lockable by Velcro surfaces either over the wrist and watch or under the wrist.

1 Claim, 1 Drawing Figure

WATCHBAND

BACKGROUND OF THE INVENTION

1. Field of the Invention

This invention relates to watchbands, and particularly to a watchband providing means for selectively covering or uncovering a watch.

2. General Description of the Prior Art

There are many occupations wherein at times the wearer of a wristwatch finds it necessary or desirable to protect the watch for discrete periods while engaged in certain activities which might result in damage to an unprotected watch. For example, such is often the case with watches worn by military personnel while engaged in field activities.

It is the object of this invention to provide such a protective watchband.

SUMMARY OF THE INVENTION

In accordance with this invention, a watchband is constructed wherein first, second, and third ribbon-like flaps extend from a common interconnection or junction. All three of the flaps have Velcro interengaging end surfaces on one side, the Velcro surfaces of the first and second flaps being relatively smaller and of opposite character to that of the Velcro surface on the third flap. The Velcro surfaces are arranged on discrete sides of the flaps, whereby the combination of Velcro surfaces of the first and third flaps interlock to hold the band on one's wrist, and the Velcro surfaces on the second and third flaps are interlockable with the second flap positioned over the watch or under the wrist.

DETAILED DESCRIPTION OF THE DRAWINGS

Figure 1:
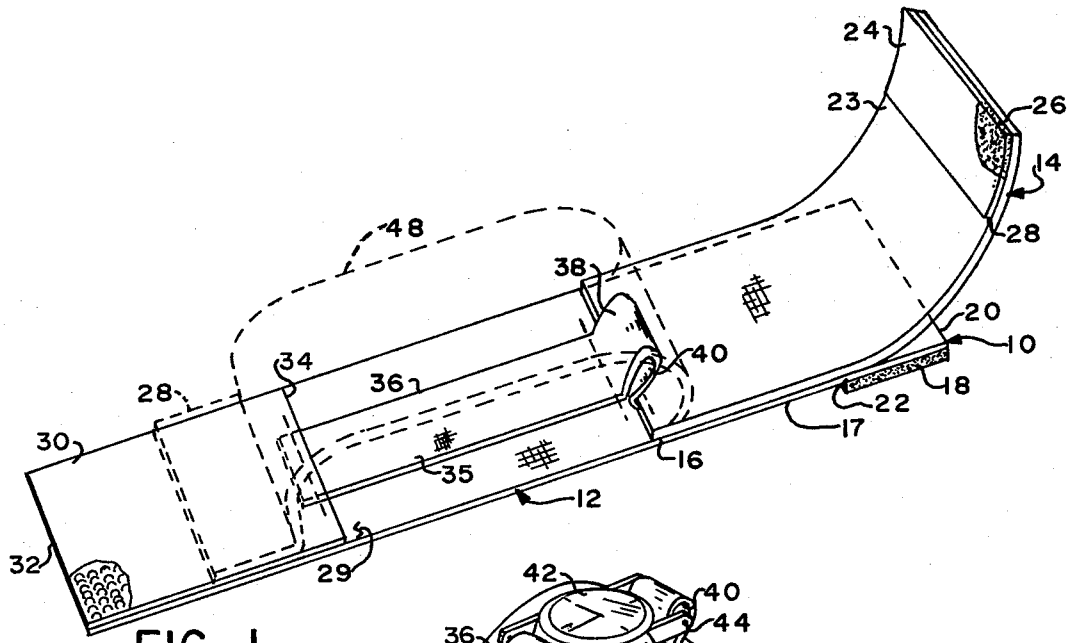
FIG. 1 is a pictorial view illustrating the watchband of this invention.

The watchband of this invention employs three thin flexible ribbon-like flaps 10, 12, and 14 which join at a common junction 16. Flap 10 has sewn or otherwise attached to its underside 17 a strip 18 of Velcro, this strip extending from edge 20 to a point 22 on flap 10, typically a distance of $\frac{3}{4}$ to $1\frac{1}{4}$ inches. Flap 10 is typically 2 to 4 inches in length. Flap 14 has sewn on its top side 23 a strip 24 of Velcro, this strip extending from end 26 to an edge 28 on flap 14, typically a distance of $\frac{3}{4}$ to $1\frac{1}{4}$ inches. Flap 14 is longer than flap 10, typically being 4 to 6 inches in length. Flap 12 has sewn on its top side 29 a strip 30 of Velcro, this strip extending from end 32 to an edge 34 on flap 12, typically a distance of 2 to 3 inches. Velcro strips 18 and 24 are of a first character and are adapted to interlock with Velcro strip 30, which is of a second character.

A relatively narrow strap 36 of, for example, cotton webbing of $\frac{1}{2}$ to $\frac{3}{4}$ inch in width is connected as a loop 35 between junction 16 and edge 34 of Velcro strip 34, typically a distance of $2\frac{1}{4}$ to $2\frac{1}{2}$ inches. End region 38 of strap 36 is gathered and sewn to form a small loop 40, and these two loops provide attachment means for watch 42 (FIG. 2), pin shafts 44 and 46 of which fit through the loops. By this configuration, watches having different dimensions between pin shafts may be readily accommodated.

Figure 2:
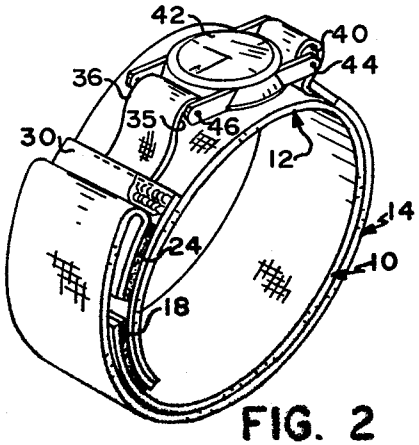
FIG. 2 is a pictorial view of the watchband shown in FIG. 1, together with a watch affixed thereto, and with the band arranged for viewing the watch.

FIG. 2 illustrates flaps 10 and 12 forming an adjustable dimension closed cylinder for attachment to the wrist of a wearer with Velcro strips 18 and 30 interlocked. This figure also illustrates flap 14 turned under and with Velcro strip 24 folded back to engage and thus lock flap 14 to a region of Velcro strip 30 in a "stowed" position when it is desired to normally observe watch 42.

FIG. 1 illustrates by dashed line 48 flap 14 turned over the top side of flap 12 and wherein Velcro strips 24 and 30 would be interlocked, and thus flap 14 would provide a protective cover for a watch when held by loops 35 and 40, as shown in FIG. 2.

Viewing FIG. 1, it is to be appreciated that either flaps 12 and 14 or 10 and 12 may be made of a single piece of material. As to material, typically the flaps would be made of nylon webbing. While the connections between components are typically sewn, it is to be appreciated that other known methods of connection may be employed.

As seen from the foregoing, the applicants have determined a new and useful watchband. It is readily placed on the arm and removed without any snaps, and significantly it provides a watchband which provides means for readily covering and uncovering a watch; to protect it from brush, debris, or other torn matter; and when this requirement does not exist, the covering portion may be looped back and attached out of the way to enable unrestricted vision of the watch.

Having thus disclosed our invention, what is claimed is:

1. A watchband comprising:

first, second, and third flaps of relatively flat flexible material meeting along and attached together at a common junction, said second flap being shorter than said third flap;

attachment means extending for a selected distance from adjacent said common junction and positioned on a first side of said first flap for attaching a watch to said first flap;

a first Velcro surface of a first character on said first side of said first flap and extending substantially between an end of said first flap and said attachment means;

a second Velcro surface of a second character extending from the end of said second flap along said second flap, and said second surface of Velcro being on a side of said second flap adapted to mate with said first flap without folding when the first and second flaps together encircle a wrist of a wearer with said first side of said first flap facing outward and said second Velcro surface facing inward;

a third Velcro surface of a second character affixed to an end region of said third flap and being on a side of said third flap, wherein when said third flap is extended in a first direction over said attachment means, said first and third Velcro surfaces may be engaged and attached without folding;

whereby when said first and second flaps are in an encircling configuration around the wrist, a watch held by said attachment means may be securely covered by said third flap; and whereby when said third flap is extended in an opposite direction over said second flap, and the end region of the third flap having the third surface thereon is folded back, said third surface and said first surface may be engaged and attached enabling the watch to be viewed without interference from the third flap.

* * * * *